United States Patent [19]

Withers et al.

[11] Patent Number: 4,634,105

[45] Date of Patent: Jan. 6, 1987

[54] ROTARY DEVICE FOR TREATING MOLTEN METAL

[75] Inventors: Christopher J. Withers, Stourbridge; David W. Pattle, Lichfield, both of United Kingdom

[73] Assignee: Foseco International Limited, Birmingham, England

[21] Appl. No.: 797,022

[22] Filed: Nov. 12, 1985

[30] Foreign Application Priority Data

Nov. 29, 1984 [GB] United Kingdom ..... 8430194
Nov. 29, 1984 [GB] United Kingdom ..... 8430195

[51] Int. Cl.[4] ..... C21C 7/00

[52] U.S. Cl. ..... 266/217; 75/61; 75/93 R; 75/59.1

[58] Field of Search ..... 75/93 R, 61, 59; 266/217

[56] References Cited

U.S. PATENT DOCUMENTS

| | | | |
|---|---|---|---|
| 3,227,547 | 1/1966 | Szekely | 75/59 |
| 3,278,295 | 10/1966 | Ostberg et al. | 75/61 |
| 3,554,518 | 1/1971 | Ostberg | 75/61 |
| 3,743,263 | 7/1973 | Szekely | 75/68 R |
| 3,767,382 | 10/1973 | Bruno et al. | 75/68 R |
| 3,839,019 | 10/1974 | Bruno et al. | 75/68 R |
| 3,849,119 | 11/1974 | Bruno et al. | 75/68 R |
| 3,870,511 | 3/1975 | Szekely | 75/68 R |
| 3,972,709 | 8/1976 | Chia | 75/61 |
| 4,040,610 | 8/1977 | Szekely | 75/68 R |
| 4,047,938 | 9/1977 | Szekely | 75/67 A |
| 4,195,823 | 4/1980 | Narita | 75/61 |
| 4,372,541 | 2/1983 | Bocourt et al. | 75/61 |
| 4,401,295 | 8/1983 | Yoshida | 75/68 R |
| 4,426,068 | 1/1984 | Gimond et al. | 266/217 |
| 4,443,004 | 4/1984 | Hicter et al. | 266/226 |

FOREIGN PATENT DOCUMENTS

| | | |
|---|---|---|
| 69434 | 1/1983 | European Pat. Off. . |
| 42196 | 3/1984 | European Pat. Off. . |
| 142727 | 5/1985 | European Pat. Off. . |
| 155701 | 9/1985 | European Pat. Off. . |
| 59-16804 | 4/1984 | Japan . |
| 1266500 | 3/1972 | United Kingdom . |
| 1316578 | 5/1973 | United Kingdom . |
| 1367069 | 9/1974 | United Kingdom . |
| 1492126 | 11/1977 | United Kingdom . |
| 1498198 | 1/1978 | United Kingdom . |

*Primary Examiner*—Peter D. Rosenberg
*Attorney, Agent, or Firm*—Nixon & Vanderhye

[57] ABSTRACT

A rotary device for dispersing a gas in molten metal, for example argon in molten aluminum, contained in a vessel, comprises a hollow shaft and a hollow rotor fixedly attached to the shaft, the rotor having a plurality of vanes each extending from the shaft, or a location adjacent the shaft, towards the periphery of the rotor whereby the hollow interior of the rotor is divided into a plurality of compartments, at least one aperture in the top or bottom of the rotor adjacent the shaft and at least one aperture in the peripheral surface of the rotor such that when the rotor rotates molten metal can enter each of the compartments through the aperture or apertures in the top or bottom, and flow outwardly through the peripheral aperture or apertures and at least one duct for the passage of the gas extending from the hollow interior of the shaft to each of said compartments. The gas and molten metal are mixed together within the rotor and on emerging from the rotor the gas is dispersed throughout the body of the molten metal as a stream of very small bubbles.

19 Claims, 8 Drawing Figures

FIG.1.
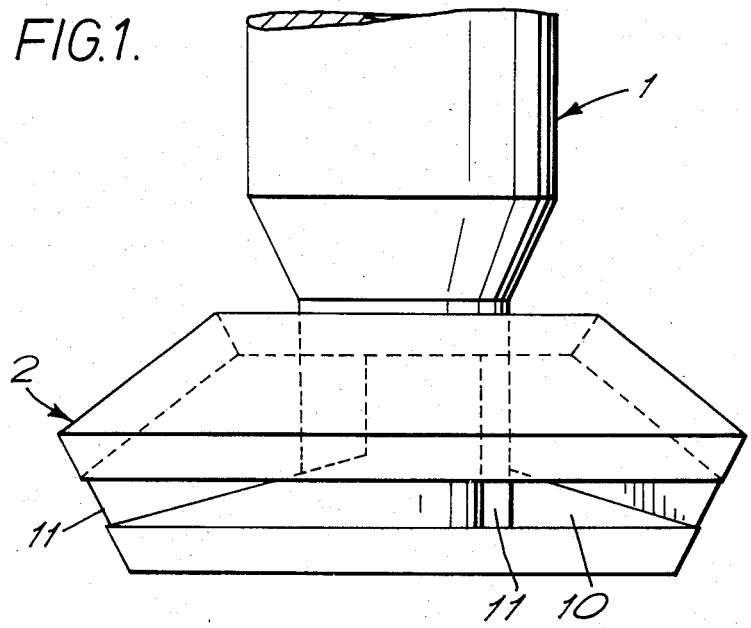
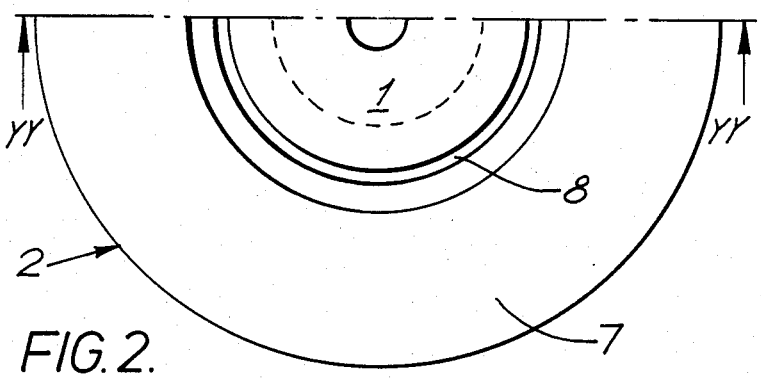
FIG.2.

ROTARY DEVICE FOR TREATING MOLTEN METAL

This invention relates to a rotary device, apparatus and a method for treating molten metal wherein a gas is dispersed in the molten metal. The device, apparatus and method are of value in the treatment of a variety of molten metals such as aluminium and its alloys, magnesium and its alloys, copper and its alloys and ferrous metals. They are of particular value in the treatment of molten aluminium and its alloys for the removal of hydrogen and solid impurities, and they will be described with reference thereto.

It is well known that considerable difficulties may arise in the production of castings and wrought products from aluminium and its alloys due to the incidence of defects associated with hydrogen gas porosity. By way of example, the formation of blisters during the production of aluminium alloy plate, sheet and strip may be mentioned. These blisters, which appear on the sheet during annealing or solution heat treatment after rolling, are normally caused by hydrogen gas diffusing to voids and discontinuities in the metal (e.g. oxide inclusions) and expanding to deform the metal at the annealing temperature. Other defects may be associated with the presence of hydrogen gas such as porosity in castings.

It is common practice to treat molten aluminium and its alloys for the removal of hydrogen and solid impurities by flushing with a gas such as chlorine, argon or nitrogen or a mixture of such gases.

According to the invention a rotary device for dispersing a gas in molten metal comprises a hollow shaft and a hollow rotor fixedly attached to the shaft, said rotor having (1) a plurality of vanes each extending from the shaft, or a location adjacent the shaft, towards the periphery of the rotor whereby the hollow interior of the rotor is divided into a plurality of compartments, (2) at least one aperture in the top or bottom of the rotor adjacent the shaft and at least one aperture in the peripheral surface of the rotor such that when the rotor rotates the molten metal can enter each of the compartments through the aperture or apertures in the top or bottom, and flow outwardly through the aperture or apertures in the peripheral surface, and (3) at least once duct for the passage of the gas extending from the hollow interior of the shaft to each of said compartments.

According to a further feature of the invention apparatus for treating molten metal comprises a vessel and a rotary device for dispersing a gas in molten metal contained in the vessel, said device comprising a hollow shaft and a hollow rotor fixedly attached to the shaft, said rotor having (1) a plurality of vanes each extending from, or a location adjacent the shaft, the shaft towards the periphery of the rotor whereby the hollow interior of the rotor is divided into a plurality of compartments, (2) at least one aperture in the top or bottom of the rotor adjacent the shaft and at least one aperture in the peripheral surface of the rotor such that when the rotor rotates the molten metal can enter each of the compartments through the aperture or apertures in the top or bottom, and flow outwardly through the aperture or apertures in the peripheral surface, and (3) at least one duct for the passage of the gas extending from the hollow interior of the shaft to each of said compartments.

According to a yet further feature of the invention there is provided a method for the treatment of molten metal comprising dispersing a gas in molten metal contained in a vessel by means of the rotary device defined above.

The rotor of the rotary device may be formed separately from and be fixed to the shaft, or the rotor may be formed integrally with the shaft.

The rotor is preferably circular in transverse cross-section in order to reduce drag in the molten metal when the device rotates and in order that the overall weight of the rotor may be as low as possible.

The rotor may have two or more vanes and hence two or more compartments. At least three vanes and three compartments are preferred and four has been found to be a convenient number in practice. Preferably the vanes extend from the shaft, to which they may be joined or with which they may be integrally formed, to the periphery of the rotor. The vanes may extend radially or be tangential to the shaft. Although the rotor may have a plurality of apertures extending around its top or bottom surface adjacent the shaft it is convenient to adopt a single annular aperture.

It is preferred that the aperture or apertures adjacent the shaft are in the top of the rotor rather than the bottom. The rotor may have an aperture or apertures in both its top and its bottom.

Although the peripheral surface of the rotor may have more than one aperture corresponding to each of the compartments it is preferable to have one elongated aperture per compartment extending from one end of one vane to one end of another. When the vanes do not fully extend to the periphery of the rotor the peripheral surface may have a single aperture extending around the periphery.

If desired there may be more than one gas duct extending from the hollow shaft through the wall of the shaft to each of the compartments but in practice it has been found that one duct per compartment is satisfactory.

In use the shaft is connected to drive means, either through a drive shaft or directly at the top of the shaft, or through the base of the rotor at the bottom of the shaft, and the device is immersed in the vessel containing the molten metal in which it is desired to disperse gas. When the device is rotated the molten metal is drawn into the compartments through the aperture or apertures in the top or bottom of the rotor and flows out of the compartments through the aperture or apertures in the peripheral surface, and is thus circulated through the rotor. The hollow interior of the shaft is connected to a source of gas and the gas passes through the shaft and then through the ducts into the compartments. The molten metal entering the compartments breaks up the gas stream as the stream leaves the ducts into a large number of very small bubbles. The bubbles are intimately mixed with the molten metal which then leaves the rotor through the aperture or apertures in the peripheral surface and as a result the gas is dispersed throughout the whole body of molten metal contained in the vessel.

The flow pattern of the molten metal and gas emerging from the rotor into the body of molten metal is determined by the geometry of the interior of the rotor. In practice it is preferred to locate the device as near to the bottom of the vessel as possible and to cause the molten metal and gas to emerge from the rotor in a substantially horizontal direction. This may be achieved, for example, by making the edge or the whole of the upper surface of the bottom of the rotor, and optionally the edge of the underside of the top of the rotor, horizontal.

The rotary device of the invention provides an efficient means for dispersing a gas stream as very small bubbles in molten metal and for distributing the dispersion throughout a large body of the molten metal. The device is particularly advantageous in that it eliminates the need for a stator which is used in certain rotray devices. The device also gives improved dispersion of the gas in the molten metal compared with other devices because a relatively large volume of the molten metal passes through the rotor and contacts the gas within the hollow rotor, and the molten metal and gas are mixed together before they emerge from the rotor.

The rotor device may be made from graphite, silicon carbide or a ceramic material which is inert to the molten metal.

The vessel used in the apparatus and method of the invention may be a ladle which may be used for the treatment of the molten metal by a batch process or the vessel may be a special construction in which the molten metal may be treated by a continuous process.

The vessel preferably has a cover or lid to avoid contact between molten metal contained in the vessel and the atmosphere, and the vessel is preferably of circular cross-section.

When the apparatus is to be used for the continuous treatment of molten metal the vessel may comprise an inlet channel, a treatment chamber and an outlet channel and the treatment chamber may have a baffle plate under which the molten metal passes before it reaches the outlet channel. The treatment chamber may have a tap-hole or tilting means so that the chamber may be emptied when it is desired to stop the continuous process e.g. when changing from one alloy to another. Alternatively the metal may be removed by pumping. These methods avoid the need to adopt a washing through procedure.

It is desirable that the apparatus has means for heating the molten metal so that the metal can be maintained at a suitable temperature during the treatment process. Immersion heaters are preferred and these are preferably located near the wall of the vessel so that they can also serve as baffles to prevent vortex formation when the rotary device is rotated in the molten metal.

Particularly when the apparatus is designed for continuous use it is desirable to include a filter through which the metal passes when it leaves the vessel. In this way any extraneous particles, which are not removed when the metal is treated with the gas, are removed by the filter.

The rotary device may be mounted on a frame so that it can be lifted out of the molten metal to enable the rotor to be serviced, and the mounting for the rotor drive arrangement can also be used as the supporting member for a cantilevered hoist assembly used for removing the lid of the vessel for maintenance purposes.

The invention is illustrated by way of example with reference to the drawings in which:

FIG. 1 is a side elevation of a rotary device according to the invention

FIG. 2 is part of a top plan view of the rotary device of FIG. 1.

Figure 3:
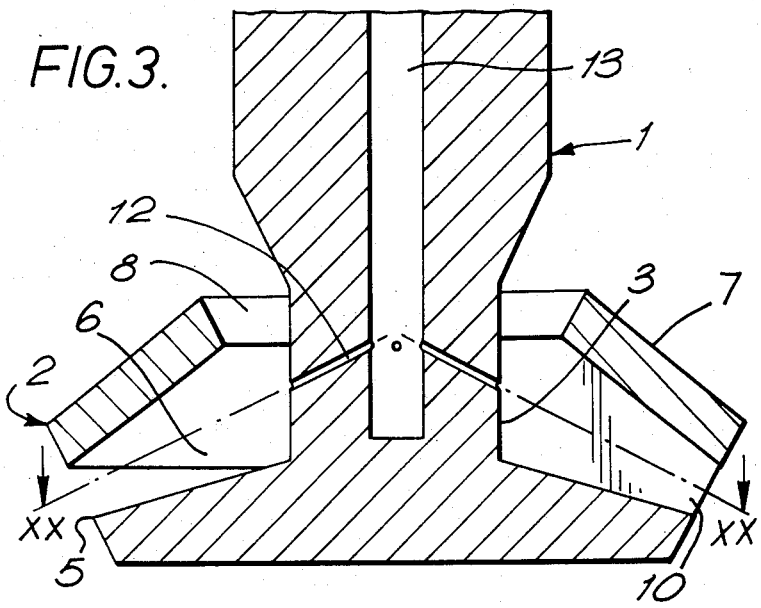
FIG. 3 is a section along YY—YY of FIG. 2.
Figure 4:
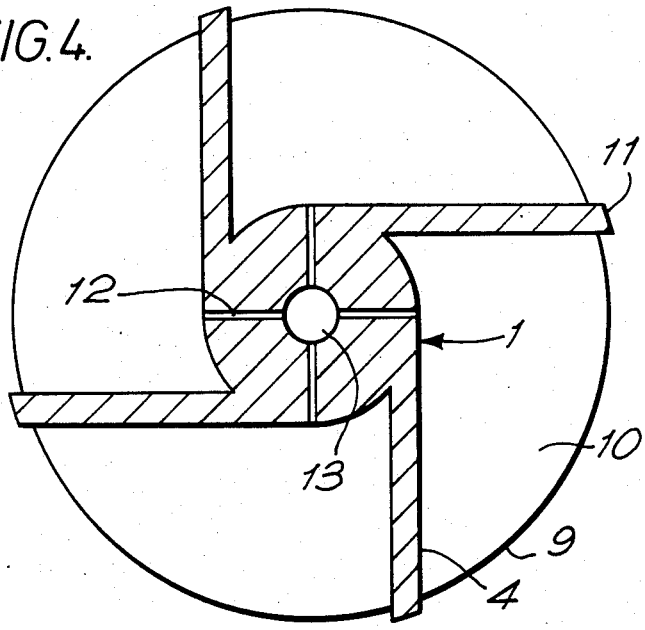
FIG. 4 is a section along XX—XX of FIG. 3.
Figure 5:
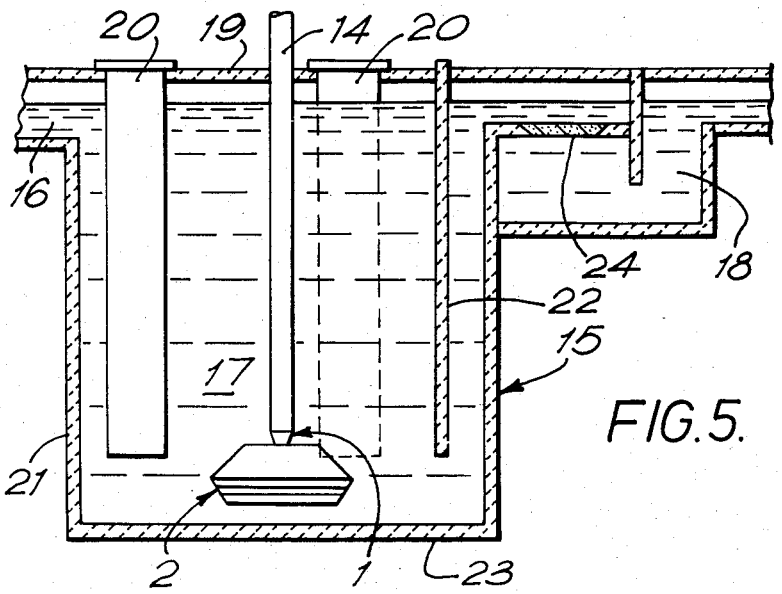
FIG. 5 is a reduced vertical sectional view of apparatus according to the invention for use in the continuous treatment of molten aluminium and incorporating the rotary device shown in Figure 1.
Figure 6:
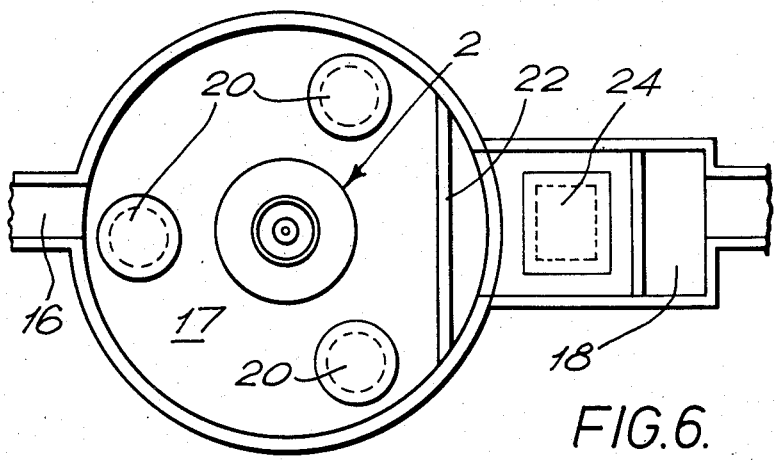
FIG. 6 is a top plan view of the apparatus of FIG. 1 with the lid removed.
Figure 7:
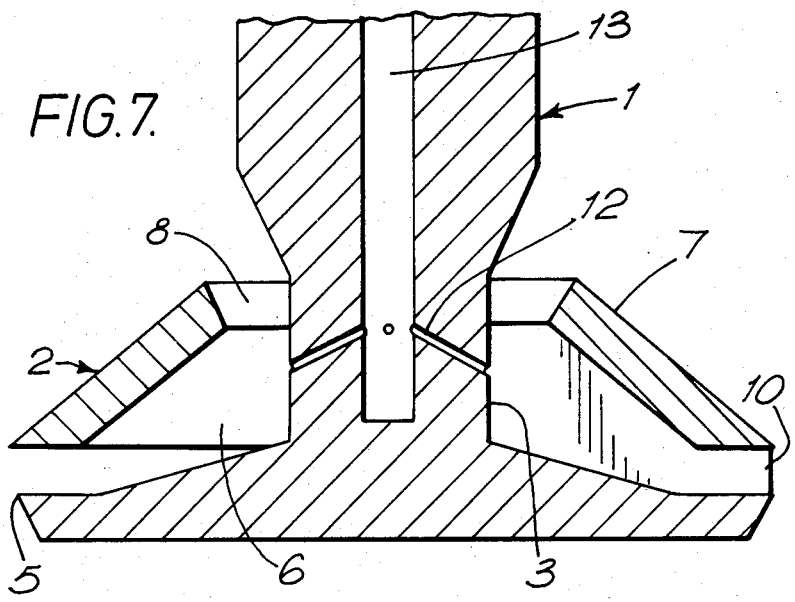
FIGS. 7 and 8 are similar views to that shown in FIG. 3 of the rotors of further embodiments of the rotary device of the invention.
Figure 8:
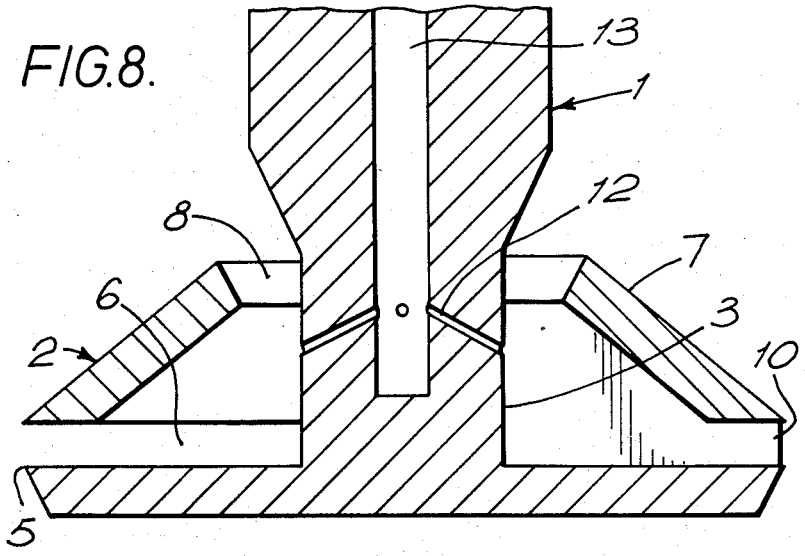

Referring to the drawings a rotary device for dispersing a gas in molten aluminium comprises a hollow shaft (1) and a hollow rotor (2) formed integrally with one end (3) of the shaft (1). Four vanes (4) tangential to the shaft (1) and formed integrally with the shaft (1) extend outwardly from the shaft (1) to the circular periphery (5) of the rotor (2) so as to divide the hollow interior of the rotor (2) into four identical compartments (6). The top (7) of the rotor (2) has an annular aperture (8) adjacent the shaft (1) and the peripheral surface (9) of the rotor (2) has four elongated apertures (10), each aperture extending from the end (11) of one vane (4) to the end (11) of another vane (4). The shaft (1) has four ducts (12) for the passage of gas each duct (12) extending through the wall of the shaft (1) and communicating with the hollow interior (13) of the shaft (1) and one of the compartments (6).

The shaft (1) is connected to the lower end of a hollow drive shaft (14) whose upper end is connected to drive means, such as an electric motor, (not shown), and the hollow interior (13) of the shaft is connected through the hollow drive shaft (14) to a source of gas (not shown).

The rotary device is located inside a refractory lined vessel (15) having an inlet channel (16), a treatment chamber (17), an outlet channel (18) and a lid (19). The chamber (17) has three immersion heaters (20) located radially adjacent the wall (21) of the chamber (17), and a baffle plate (22) extending towards the bottom (23) of the chamber (17) and located adjacent the outlet channel (18). The outlet channel (16) contains a porous ceramic filter (24).

In use molten metal enters the vessel (15) continuously via inlet channel (16) passes through the treatment chamber (17) and leaves via outlet channel (18).

The rotary device is rotated in the molten aluminium contained in the treatment chamber (17) and gas is admitted through the shaft (1) and passes through the ducts (12) into the compartments (6) in the hollow rotor (2). As the device rotates aluminium is drawn into the compartments (6) through the annular aperture (8) where it breaks up the gas stream leaving the ducts (12) into very small bubbles which are intimately mixed with the aluminium and which flow with the aluminium out of the rotor (2) through the apertures (10) in the peripheral surface (9) of the rotor and which are dispersed through the whole body of the aluminium. Aluminium contained in the treatment chamber (17) is thus intimately contacted by the gas and dissolved hydrogen and inclusions are removed.

After treatment the aluminium passes under the baffle plate (22) and out of the treatment chamber (17) into the outlet channel (18). During its passage through the outlet channel (18) any non-metallic inclusions which may still be present are removed by the porous ceramic filter (24).

The immersion heaters (20) not only serve to maintain the aluminium in the treatment chamber (17) at the required temperature but they also act as baffles which overcome any tendency for the rotary device to produce a vortex in the aluminium. Since the heaters can be kept continuously immersed in the aluminium their failure rate due to thermal shock is reduced.

The following Examples will serve to illustrate the invention:

Four graphite rotary devices similar to those shown in the drawings were each used to treat 750 kg molten aluminium at 750° C. with argon gas by a batch process. In each case the hydrogen content of the aluminium was determined before and after the treatment process. Data on the rotors and the process conditions, and the results are tabulated below:

| | ROTOR NUMBER | | | |
|---|---|---|---|---|
| | 1 | 2 | 3 | 4 |
| ROTOR DIAMETER (mm) | 175 | 295 | 295 | 295 |
| ROTOR HEIGHT (mm) | 60 | 120 | 130 | 120 |
| NUMBER OF VANES | 4 | 4 | 4 | 4 |
| TYPE OF VANES | TANGENTIAL | TANGENTIAL | RADIAL | TANGENTIAL |
| INLET APERTURE AREA ($cm^2$) | 8.2 | 20.3 | 8.7 | 20.3 |
| OUTLET APERTURE AREA ($cm^2$) | 16.5 | 41.8 | 38.0 | 41.8 |
| COMPARMENT VOLUME ($cm^3$) | 95 | 670 | 680 | 670 |
| NO. OF GAS DUCTS | 4 | 4 | 4 | 8 |
| GAS DUCT DIAMETER (mm) | 1 | 1 | 1 | 1 |
| ROTOR SPEED (R.P.M.) | 400 | 280 | 380 | 280 |
| GAS FLOW (normal l/min.) | 20 | 35 | 35 | 35 |
| HYDROGEN CONTENT OF ALUMINIUM ($cm^3$/100 g) AFTER: | | | | |
| 0 MINUTES | 0.20 | 0.38 | 0.23 | 0.26 |
| 2 MINUTES | — | 0.21 | 0.11 | 0.10 |
| 5 MINUTES | — | 0.20 | 0.06 | — |
| 7 MINUTES | 0.08 | — | — | — |
| 8 MINUTES | — | 0.15 | — | — |

We claim:

1. A rotary device for dispersing a gas in molten metal comprising a rotatable hollow shaft and a hollow rotor fixedly attached to the shaft, said rotor comprising top, bottom and peripheral surfaces and a hollow interior, and said rotor having
   (1) a plurality of vanes each extending from adjacent the shaft, towards the peripheral surface of the rotor whereby the hollow interior of the rotor is divided into a plurality of compartments,
   (2) means for defining at least one aperture in at least one of the top and bottom surfaces of the rotor, adjacent the shaft, and at least one aperture in the peripheral surface of the rotor, so that when the rotor rotates the molten metal can enter each of the compartments through the at least one aperture in at least one of the top and bottom surfaces, and flow outwardly through the at least one aperture in the peripheral surface, and
   (3) at least one duct for the passage of the gas, the duct extending from the hollow interior of the shaft to each of said compartments.

2. A rotary device according to claim 1 wherein the rotor is formed separately from and is fixed to the shaft.

3. A rotary device according to claim 1 wherein the rotor is formed integrally with the shaft.

4. A rotary device according to claim 1 wherein the rotor is circular in transverse crosssection.

5. A rotary device according to claim 1 wherein the vanes are joined to or are integrally formed with the shaft.

6. A rotary device according to claim 1 wherein the vanes extend to the peripheral surface of the rotor.

7. A rotary device according to claim 1 wherein the vanes extend radially.

8. A rotary device according to claim 1 wherein the vanes are tangential to the shaft.

9. A rotary device according to claim 1 wherein the rotor has a single annular aperture in its top or bottom surface adjacent the shaft.

10. A rotary device according to claim 1 wherein the rotor has one or more apertures in both its top and its bottom surfaces.

11. A rotary device according to claim 1 wherein the peripheral surface of the rotor has one elongated aperture per compartment extending from one end of one vane to one end of another vane.

12. A rotary device according to claim 1 wherein the rotor has a single aperture extending around the peripheral surface thereof.

13. Apparatus for treating molten metal comprising a vessel and a rotary device for dispersing a gas in molten metal contained in the vessel, said device comprising a rotatable hollow shaft and a hollow rotor fixedly attached to the shaft, said rotor comprising top, bottom and peripheral surfaces and a hollow interior, and said rotor having
   (1) a plurality of vanes each extending from adjacent the shaft, towards the peripheral surface of the rotor whereby the hollow interior of the rotor is divided into a plurality of compartments,
   (2) means for defining at least one aperture in at least one of the top and bottom surfaces of the rotor adjacent the shaft and at least one aperture in the peripheral surface of the rotor, so that when the rotor rotates the molten metal can enter each of the compartments through the at least one aperture in the at least one of top and bottom surfaces, and flow outwardly through the at least one aperture in the peripheral surface, and
   (3) at least one duct for the passage of the gas, the duct extending from the hollow interior of the shaft to each of said compartments.

14. Apparatus according to claim 13 wherein the vessel is a ladle.

15. Apparatus according to claim 13 wherein the vesesl comprises an inlet channel, a treatment chamber and an outlet channel.

16. Apparatus according to claim 15 wherein the treatmemt chamber has a baffle plate.

17. Apparatus according to claim 13 wherein the vessel contains one or more immersion heaters.

18. Apparatus according to claim 17 wherein the immersion heaters are located near the wall of the vessel.

19. Apparatus according to claim 15 wherein the outlet channel contains a filter.

* * * * *